United States Patent [19]

Peytavin

[11] Patent Number: 4,641,513

[45] Date of Patent: Feb. 10, 1987

[54] COLD ROLLING PROCESS FOR TUBES, BY MEANS OF A PILGER ROLLING MILL AND THE ROLLING MILL FOR ITS EXECUTION

[75] Inventor: Pierre Peytavin, Neuilly, France

[73] Assignee: Vallourec, France

[21] Appl. No.: 635,458

[22] Filed: Jul. 30, 1984

[30] Foreign Application Priority Data

Aug. 1, 1983 [FR] France ..... 83 12922

[51] Int. Cl.[4] ..... B21B 21/04

[52] U.S. Cl. ..... 72/214; 72/208; 72/250

[58] Field of Search ..... 72/214, 208, 209, 250

[56] References Cited

U.S. PATENT DOCUMENTS 3,030,835 4/1962 Krause ..... 72/214 X 4,157,025 6/1979 Vydrin et al. ..... 72/214 X

*Primary Examiner*—Francis S. Husar

*Assistant Examiner*—Steve Katz

*Attorney, Agent, or Firm*—McDougall, Hersh & Scott

[57] ABSTRACT

A method for cold rolling a tubular blank using a Pilger rolling mill, the tubular blank being rolled between a mandrel, lodged inside it, and the grooves of a pair of rolls, mounted within a stand which performs a back and forth motion along the axis of the tubular blank, the rolls being driven in rotation alternatively in one direction and in the other, in synchronism with the movements of the stand, a forward motion of the blank being done at least at proximity of the downstream neutral point. During at least a part of the return run of the stand, a holding back device, placed on the downstream side relative to the stand, prevents the displacement of the already rolled tubular blank along the rolling axis in the upstream direction during the return rolling run.

5 Claims, 3 Drawing Figures

COLD ROLLING PROCESS FOR TUBES, BY MEANS OF A PILGER ROLLING MILL AND THE ROLLING MILL FOR ITS EXECUTION

The process and the device which are the objects of the present invention relate to cold rolling of tubes by means of a Pilger mill. A Pilger mill for cold rolling comprises in a known manner grooved rolls, assembled in a roll-carrying stand which perform a back and forth motion in the direction of the rolling axis, the tubular blank being periodically displaced downstream.

The rolls are driven into rotation once in one direction and then in the other direction, in synchronism with the displacements of the stand.

A mandrel is placed in the axis of the tubular blank, which also constitutes the rolling axis, so that the blank will be rolled between said mandrel and the grooves of the rolls.

For the clarity of the presentation, there is hereafter designated by upstream side the side through which the blank to be rolled enters the roll-carrying stand, and by downstream side, the side from which the tube exits the stand after reduction of its section by rolling between the rolls. There is designated by "going" displacement the downstream-upstream displacement of the stand and of the roll, and by "return" displacement, the downstream-upstream displacement, along the axis of the blank.

French Pat. No. 1602013 describes a Pilger rolling mill in which the forward motion of the rough piece, along the rolling axis is executed in a manner synchronized with the back and forth motions of the stand, so that said forward motion will occur at the time when the stand is close to the corresponding upstream neutral point which corresponds to the end of the return run of the stand. At the same time as the tubular blank is moved forward by a given quantity, it is rotated on its axis by a fraction of a rotation by means of rotating tube pinchers.

French Pat. No. 2463646 describes the execution, for the purpose of increasing productivity, of a forward motion of the tubular blank at each one of the two upstream and downstream neutral points.

That document specifies that the forward motions imposed to the tubular blank may be, depending on the case, more important upstream than downstream, or the contrary. Experience has shown that when a forward motion is imposed on the tubular blank in the neighborhood of the downstream neutral point, there occurs during the rolling phase during the return of the tube on the mandrel, a sliding of the already rolled part of the tubular blank along the axis in the upstream direction, which thus at least partly cancels the above performed forward motion.

That sliding in the upstream direction is especially appreciable when the driving into rotation of the rolls is done by means of toothed wheels which are solidary of the rolls which engage on racks which are fixed relative to the structure of the mill. There occurs then in the second part of the return run of the stand a driving action of the tubular blank toward upstream resulting from the fact that the distance between the bottom of the grooved channel and the corresponding roll shaft becomes inferior to the radius of the toothed wheel which drives the roll. In addition, the crushing force exerted by the bottom of the groove on the wall of the tubular blank is not perpendicular to the axis of the tube, but slanted relative to same so that its horizontal component is directed toward upstream.

It is easy to understand that when that component has a sufficient intensity it causes a sliding of the rough already rolled part of the tubular blank in the upstream direction, which (sliding) partly cancels the forward motion which had been executed at the downstream neutral point. The importance of that sliding depends on numerous factors such as, among other things, the profile of the rolls grooves and that of mandrel associated with them, the degree of reduction of the tubular blank section, and the value of the radii of the roll synchronization pinions.

In the case when there is a pushing system for the tubular blank which works on the end of the latter, for example by means of a cam, it is not sufficient to give the latter a suitable profile to prevent the backward motion of the rear end of the tubular blank.

Indeed, during the return part of the rolling, the axial component of the pressure force exerted by the rolls on the tubular blank reaches a very high intensity, and it is very difficult to execute a tube pushing device which presents a sufficient mechanical firmness to resist the forces thus developed. Further, a certain elastic recoil would not be avoided.

Efforts have thus been made to find the possibility of developing a cold rolling process for tubes by means of a Pilger mill, in which it would be possible to execute a forward motion of the tubular blank close to the downstream neutral point, followed by a rolling operation on the return run, during which there would be avoided the recoil motion of the already completed rolled part. There has also been sought the possibility of developing a simple device which makes it possible to obtain that result.

The process which is the object of the present invention consists in executing a cold rolling mill of the Pilger type, in which a tubular blank is rolled between a mandrel lodged inside it, and the grooves of a pair of rolls mounted in a rotating manner on bearings solidary of a stand which performs a back and forth motion along the axis of the rough piece of tube, the rolls being driven into rotation alternately in one direction then in the other, in synchronism with the movements of the stand, and in which the forward motion of the tubular blank along the axis is performed at least close to the downstream neutral point; in that process, during part at least of the return run of the stand, from the downstream neutral point to the upstream neutral point, a holding back means placed on the downstream side relative to the stand, is connected with the part of the tubular blank rolled and prevents or limits the displacement of that rolled part along the rolling axis, in the upstream direction during the return rolling phase. Preferably, the holding back means in the course of each back and forth motion of the roll-carrying stand, exerts a gripping action on the tubular blank from the time when, the stand having reached the proximity of the downstream neutral point, the tubular blank has been moved forward by a given quantity and it maintains the action until said stand reaches the proximity of the upstream neutral point, the gripping action being then interrupted to release the tube tubular blank. Advantageously, the forward motion of the tubular blank at the downstream neutral point will be combined with a rotation of said rough piece around its axis by a fraction of a revolution, before the holding back means exerts a gripping action.

In that process, the tubular blank can also be moved forward and made to rotate by a fraction of a revolution in the proximity of the upstream neutral point after being released by the holding back means.

The present invention also relates to a cold Pilger mill equipped with a holding back device for the rolled tubular blank, for the execution of the above-described rolling process. Said rolling installation of the Pilger type comprises a mandrel lodged inside the tubular blank to be rolled, a roll-carrying stand movable in a back and forth motion parallel to the rolling axis, a pair of grooved rolls mounted rotating on bearings solidary of the stand and placed on each side of the mandrel, a means for the driving into rotation of the rolls, in one direction or in the other, in synchronism with the displacements of the stand, a means commanding the axial forward motion of the tubular blank to be rolled, at least in the proximity of the downstream neutral point.

A gripping means is placed downstream from the roll-carrying stand, around the already rolled part of the tubular blank, said gripping means comprising jaws one of which at least is movable, capable of gripping the already rolled part of the tubular blank in order to oppose the displacement of said part along the rolling axis, in the upstream direction, or on the contrary to release said tubular blank so as to permit its displacement along the rolling axis and/or its rotation around said axis.

The gripping means is made solidary of a resistant (strong) support. Advantageously, the jaws are made solidary of the rolling-mill by means of the jaw-carrier.

Preferably, the jaws are self-gripping when they exert on the rolled part of the tubular blank a holding back force which opposes itself to its upstream displacement.

The self-gripping action advantageously is executed by fitting at least one of the jaws with a flat face supported against the bearing plate of its lodging, with respect to which it can slide, the sliding plane being slanted relative to the axis, so that its extension cuts said axis upstream. The jaw then behaves in the manner of a wedge. Preferably also, the opening or closing of the jaws is commanded by at least one simple or double action jack. Finally, there is advantageously placed an outlet tube pincher which ensures the rotation of the tubular blank around its axis by a fraction of a revolution at the time when the roll-carrying stand is located close to at least one of the two upstream or downstream neutral points, said tube pincher preferably being installed downstream from the holding back device. The figures and the more detailed description which follows, make it possible better to understand, in a manner which is not limitative, the conditions of execution of the present invention.

FIG. 1 shows in a schematic manner a Pilger-mill.

Figure 1:
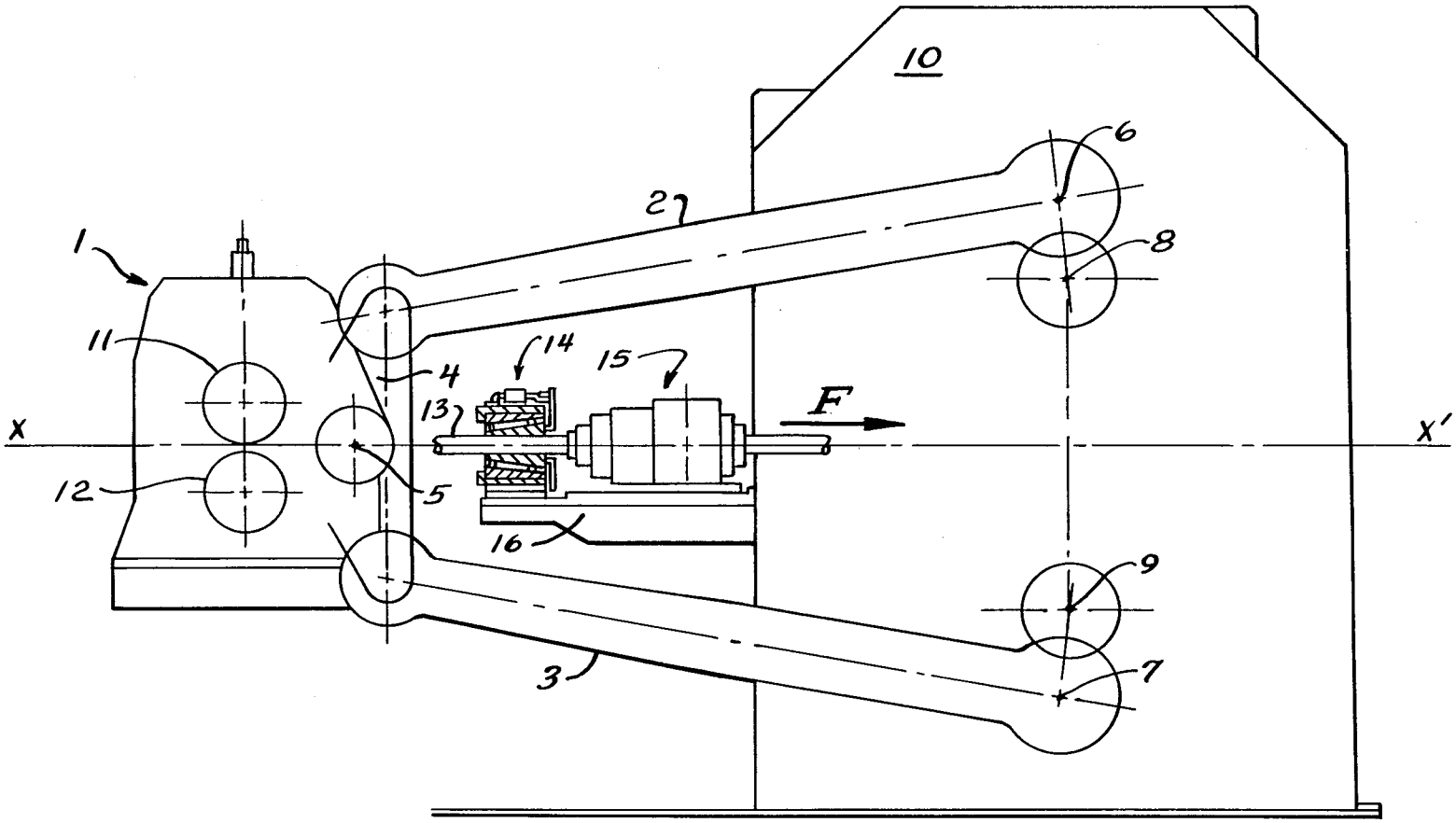
FIG. 1 is a general schematic view of the front part of a cold Pilger mill, which makes possible the rolling of tubular blank, which comprises a holding back device according to the present invention, presented in axial section, which makes it possible to execute, also, the process according to the present invention.

The roll-carrying stand (1) is partially represented, and in a schematic manner. It moves with a back and forth motion on glides which are not represented and which are parallel to the rolling axis XX'. That back and forth motion of the stand is executed by means of connecting rods (2, 3) connected at one end of their ends to stand (1) by means of a swingle tree (4) articulated in (5), and at the other end by means of eccentric articulations (6, 7) to shafts (8, 9) which are driven into rotation in a synchronized manner at approximately constant speed by means of a motor which is not represented. Shafts, (8, 9) rotate in bearings which are solidary of a carter (10) which itself is solidary of the structure of the rolling-mill.

Stand (1) comprises in a manner known in itself, two grooved rolls (11, 12) which are driven into rotation, in a manner which is not represented, by toothed wheels assembled at the end of the shafts of the rolls, which engage on fixed gear racks. The tubular blank, an already rolled part (13) of which is seen, is carried also in a manner known in itself, by a fixed mandrel which is not represented, the profiled downstream end of which cooperated with the grooves of rolls (11, 12) to make possible the reduction of the tubular blank by rolling to the desired dimensions.

Downstream from stand (1), the holding back device (14) according to the present invention, then the tube-pinching device (15) are placed along the axis XX' and they surround the downstream part (13) of the rough piece of tube in its already rolled zone.

Said rolling mill is also equipped with a governing device which commands the axial forward motion of the part of the tubular blank to be rolled, which makes it possible to feed the rolling mill at least in the proximity of the downstream neutral point. That device may be of any known type and it is not represented. Such a device is found, for example, in Belgian Pat. No. 694 241 (which described an axial governing device).

Arrow F shows the general displacement direction of the tubular blank from upstream to downstream, along the rolling axis XX'.

The holding back device (14) and the tube pinching device (15) are fixed on a firm support (16), which in the present case is itself solidary of the structure of the rolling-mill. The tube pincher device, also sometimes called the tube-rotating device and which is known in itself, makes it possible to cause the tubular blank to rotate around its axis when the roll-carrying stand is located close to the upstream and downstream neutral points; it exerts only a limited gripping on the tube, which allows for the sliding of same along the rolling axis (XX') through that device either during the rolling process or during the forward motion.

Figure 3:
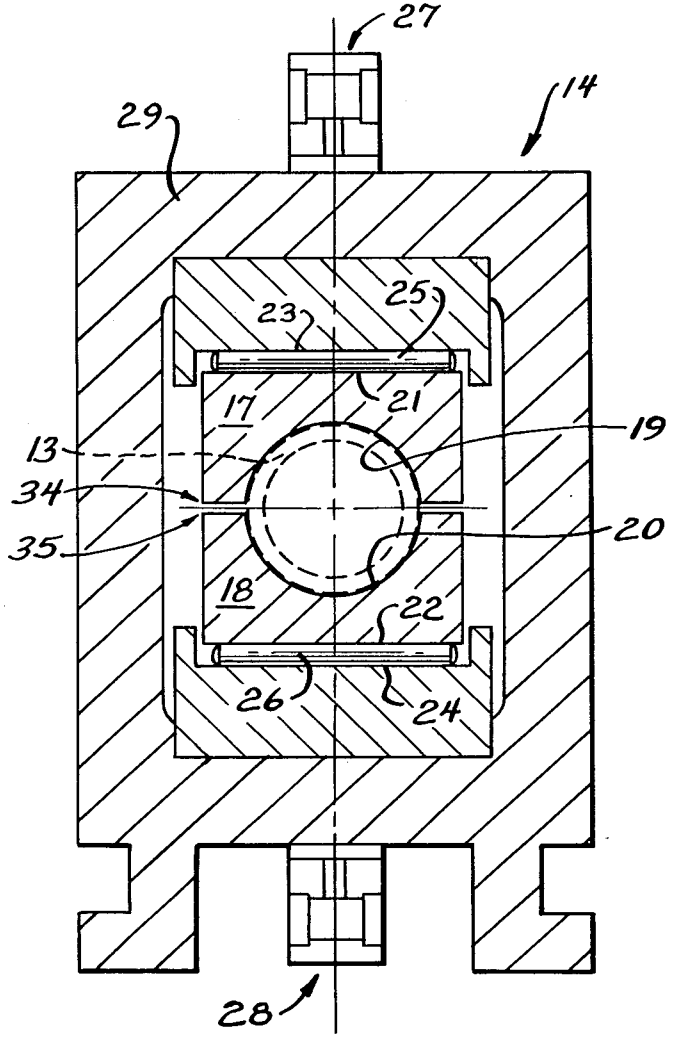
FIG. 3 is a section view, along line A—A, of the device represented in FIG. 2.
Figure 2:
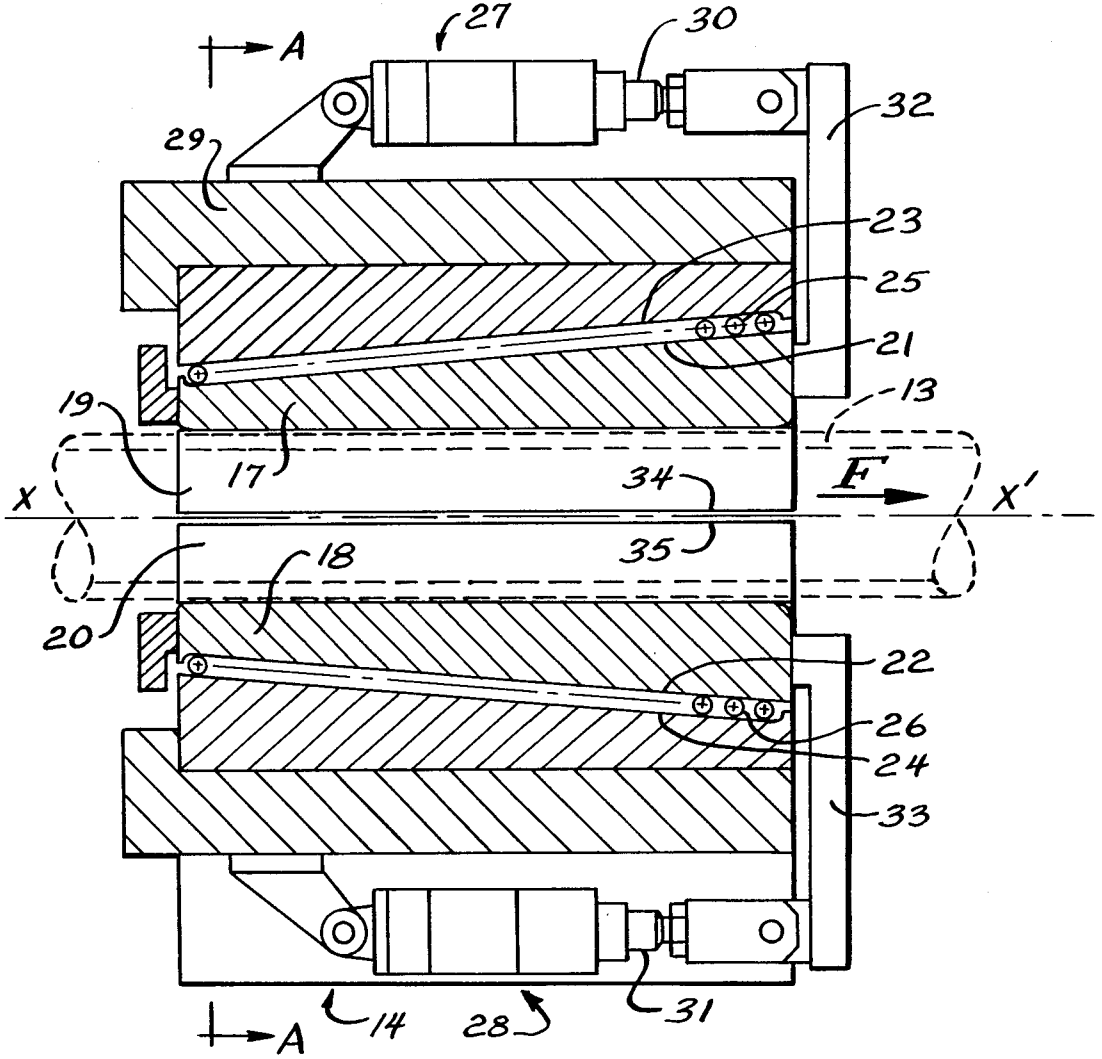
FIG. 2 is a more detailed view of the holding back device seen in FIG. 1, also in axial section.

FIGS. 2 and 3 show, in a more detailed manner, the holding back device (14). Arrow F indicates the general direction of displacement of the tubular blank. That device comprises two jaws (17, 18) which each comprise a smooth bearing surface (19, 20) approximately half-cylindrical, the dimensions of which are such that when the two jaws are tightened against each other the smooth bearing surfaces (19, 20) come to be supported against the external surface of the rough piece of tube (13) in its already rolled zone which is located immediately downstream from the most forward downstream position of stand (1). Generally, that already rolled zone of the tube is located beyond the downstream end of the mandrel.

In order to obtain a self-gripping of the jaws (17, 18) when the rolled part of the tubular blank is subjected to a traction force in the upstream direction, especially in the course of the rolling of the tubular blank during the return run of the roll-carrying stand, there is given to the complex of the two jaws the shape of a wedge. To that end of the faces (21, 22) opposed to the bearing surfaces (19, 20) are flat and slanted relative to the axis XX', so as to converge in the upstream direction. In order to facilitate the sliding of the jaws (17, 18) by their faces (21, 22) on the support planes (23, 24) there is left between the flat surfaces which face each other an interval inside which there is lodged a plurality of small rolling discs or rollers which are cylindrical and circular such as (25, 26).

It is easy to understand that due to the wedge shape, the gripping force of the jaws increases at the same time as the traction force exerted on the tubular blank in the upstream direction increases. In order to prevent a slight sliding of the already rolled part of the tubular blank (13) inside the jaws when said blank begins to be subjected to a traction force in the upstream direction, there is ordered, prior to any traction force, a pre-gripping of each one of the jaws (17, 18) by two jacks (27, 28) fixed on the external envelope (29) of the device. Piston rods (30, 31) of those jacks, commanded by fluids, act on the jaws by means of connecting parts (32, 33). It can be seen that by causing the displacement of the pistons (30, 31) of each one of the jacks in a direction opposite that of arrow F, there is performed the beginning of a gripping of the jaws (17, 18) on the wall of the rough part. That tightening increases afterwards, as a function of the traction forces exerted on the tube in the upstream direction. In practice, the commanding system of the jacks is designed to act at the rate of the rolling-mill installation, so as to be synchronized with the displacements of the rollcarrying stand. That system governs the beginning of the gripping of the jaws (17, 18) at the time when the rollcarrying stand (1) is located in the proximity of the downstream neutral point, immediately after it has performed the forward motion of the tubular blank and its rotation. In the same manner, the releasing of the jaws, if it appears necessary, can be executed by causing a displacement in the opposite direction, of pistons (30, 31).

That action of the pistons then must be performed when the roll-carrying stand is located close to the upstream neutral point, immediately prior to the possible execution of a forward motion of the tubular blank and to the possible rotation by a fraction of a turn, of said blank.

The dimensions of the bearing surfaces (19, 20) are determined in a manner such that the most important forces of traction can be exerted during the rolling process without danger of their causing a crushing of the rolled part of the tubular blank of the jaw, or even a marking of the surface of said rough piece of tube in its already rolled part, which marking no longer could be eliminated in the course of the finishing operations. To that end, there is given to each one of the bearing surfaces, which are smooth, a shape approximately semi-cylindrical, the radius of the bearing surface being equal or very slightly superior to that of the external surface of the rolled part of the tubular blank. Things are arranged so that a slight play is preserved between the lateral edges such as (34, 35) of the jaws when said are in the gripping position against the rolled part of the tubular blank (13) which has already been rolled, as seen in FIGS. 2 and 3. Experience has shown that in order to obtain a sufficient gripping of the jaws on the tubular blank, which efficiently prevents the latter from moving backward, without running the risk of a permanent deformation in the gripping zone, it is advantageous to give to those jaws a bearing surface length measured in a direction parallel to the rolling axis, of the order of four to eight times the external diameter of the finished tube. The optimum length of course is a function of the material of the tubular blank, of the amount of reduction performed, and also of the shape of the roll grooves, as well as of the corresponding shape of the rolling zone of the mandrel.

The slope of the sliding or gliding planes also depends on the conditions of operation; it may for example be of the order of 5° to 11° with respect to the rolling axis.

As an example, in the case of the rolling according to the described process, with forward motion of the tubular blank at the downstream neutral point, of a tubular blank the initial diameter is approximately 115 mm, made of stainless steel of the 18-8 type, with a finished tube 75 mm in diameter, there is used a holding back device comprising two jaws with a smooth cylindrical bearing surface 500 mm in length, each one presenting a flat supporting face in the lodging, with a 6° slant respective to the axis.

Those jaws are commanded, each, by a double action jack the force of which is appropriately one ton, applied directly to the jaw in a direction parallel to the rolling axis. The traction force exerted by the part of the tubular blank which is already rolled, on the holding back device during the rolling, during the return run of the stand reaches a maximum value of approximately 50 tons. In that way there is obtained a rolling action during the return phase of the rolls, without any upstream sliding of the already rolled tube, and with an excellent rate of efficiency. Very many modifications may be brought to the process and to the device which constitute the objects of the present invention, without leaving the scope of the latter.

Especially it is not necessary to use self-gripping jaws, and it is possible to use jaws with direct mechanical or hydraulic gripping. Moreover, although it proves advantageous to place the holding back means as close as possible to the downstream side of the roll-carrying stand, it is possible to consider placing it farther downstream, especially downstream from a tube-pincher device. Although in the given example, the rolling mill is a one line installation, the invention would also be applicable to the case of a rolling installation comprising several lines which simultaneously would roll several tubes in parallel.

I claim:

1. A process for cold rolling a tubular blank by means of a Pilger rolling mill, the blank rolled between a mandrel lodged inside the blank and a pair of rolls supported on a stand, the process comprising the steps of:

(a) oscillating the stand parallel to the axis of the blank between a downstream neutral point and an upstream neutral point;

(b) driving the rolls in alternating directions in synchronism with the motions of the stand relative to the blank to work the blank during both downstream and upstream stand motions;

(c) moving the blank downstream relative to the stand when the stand is near the downstream neutral point; and (d) providing holding back means downstream of the stand; (e) holding back the blank against upstream motion, the holding back being accomplished by said holding back means whereby upstream motion of the blank is prevented and the portion of the blank which is already rolled will be prevented from re-entering the rolling phase.

2. The process of claim 1 wherein the holding back is exerted immediately after the blank is moved downstream relative to the stand and wherein the holding back is released when the stand is near the upstream neutral point.

3. The process of claim 1 further comprising the step of:

(e) rotating the blank about its axis by a fraction of a revolution when the stand is near the downstream neutral point simultaneous to movement of the blank downstream relative to the stand.

4. The process of claim 1 wherein the holding back means comprises at least one jaw to grip the blank only when the blank is forced upstream against the holding back means.

5. The process of claim 4 wherein the jaw comprises a supporting face in contact with a bearing face slanted relative to the rolling axis, the bearing face slanted toward the axis upstream, the supporting face being able to slide along the bearing face.

* * * * *